US011105569B2

(12) United States Patent
Pess et al.

(10) Patent No.: US 11,105,569 B2
(45) Date of Patent: Aug. 31, 2021

(54) HEAT EXCHANGER SPRAY TUBE

(71) Applicant: Hamilton Sundstrand Corporation, Charlotte, NC (US)

(72) Inventors: Matthew Pess, West Hartford, CT (US); Donald E. Army, Enfield, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 53 days.

(21) Appl. No.: 16/293,025

(22) Filed: Mar. 5, 2019

(65) Prior Publication Data

US 2020/0284534 A1 Sep. 10, 2020

(51) Int. Cl.

| | |
|---|---|
| ***F28G 1/16*** | (2006.01) |
| ***F28G 15/02*** | (2006.01) |
| *F28D 21/00* | (2006.01) |

(52) U.S. Cl.

CPC ..... *F28G 1/166* (2013.01); *F28G 15/02* (2013.01); *F28D 2021/0021* (2013.01)

(58) Field of Classification Search

CPC .. F28G 1/166; F28G 15/02; F28G 1/16; F28F 9/0138; F28D 2021/0021

See application file for complete search history.

(56) References Cited

U.S. PATENT DOCUMENTS

| | | | | |
|---|---|---|---|---|
| 2,121,493 | A * | 6/1938 | Thomas | F28G 1/166 122/392 |
| 4,562,885 | A * | 1/1986 | Pausch | F28G 1/166 15/318.1 |
| 4,666,531 | A | 5/1987 | Minard | |
| 5,279,357 | A | 1/1994 | Kennon et al. | |
| 8,857,071 | B2 * | 10/2014 | Lee | D06F 58/22 34/85 |
| 2009/0230217 | A1 * | 9/2009 | Stone | F28G 1/166 239/525 |
| 2014/0326280 | A1 * | 11/2014 | Al-Otaibi | F28G 1/166 134/34 |

(Continued)

FOREIGN PATENT DOCUMENTS

| | | | |
|---|---|---|---|
| CN | 203274590 | U | 11/2013 |
| EP | 2034266 | A2 | 3/2009 |

(Continued)

OTHER PUBLICATIONS

Website Product Carrier Washers—Sani-Matic, Inc., "Rack Washers for a Complete Clean of Hard-to-Clean Racks, Trees and Trucks" from <https://sanimatic.com/food-beverage/cabinet-washers/product-carrier/>.

(Continued)

*Primary Examiner* — Devon Russell
(74) *Attorney, Agent, or Firm* — Kinney & Lange, P.A.

(57) ABSTRACT

A heat exchanger cleaning arrangement includes a spray tube array configured to be attached to a heat exchanger. The spray tube array includes at least one tube, a plurality of nozzles, and a connector. The plurality of nozzles is configured to port pressurized fluid from the at least one tube toward the heat exchanger. The connector is in operable communication with the spray bar array and is configured such that a pressurized fluid source can be attached to the connector for porting fluid from the pressurized fluid source to the plurality of nozzles.

18 Claims, 6 Drawing Sheets

(56) References Cited

U.S. PATENT DOCUMENTS

| | | | | |
|---|---|---|---|---|
| 2015/0153122 | A1* | 6/2015 | Stone | F01P 11/14 134/34 |
| 2015/0211819 | A1* | 7/2015 | Lindstrom | F28G 9/00 134/34 |
| 2016/0290742 | A1* | 10/2016 | Okimoto | F28F 9/22 |
| 2019/0346222 | A1* | 11/2019 | Al-Otaibi | F28F 27/02 |
| 2020/0172251 | A1* | 6/2020 | Beckman | B01D 46/521 |
| 2020/0172252 | A1* | 6/2020 | Beckman | B64D 13/08 |

FOREIGN PATENT DOCUMENTS

| | | | | |
|---|---|---|---|---|
| FR | 2955651 | A1 | 7/2011 | |
| GB | 278854 | A * | 10/1927 | F28G 1/166 |
| WO | WO9318362 | A1 | 9/1993 | |
| WO | WO2017028959 | A1 | 2/2017 | |

OTHER PUBLICATIONS

Extended European Search Report for EP Application No. 19210662.3, dated Jul. 6, 2020, 6 pages.

* cited by examiner

HEAT EXCHANGER SPRAY TUBE

BACKGROUND

The present disclosure relates to heat exchangers. More particularly, the present disclosure relates to the cleaning of heat exchangers.

An environmental control system ("ECS") aboard an aircraft provides conditioned air to the aircraft cabin. Conditioned air is air at a desired temperature, pressure, and humidity for aircraft passenger comfort. Compressing ambient air at flight altitude heats the resulting pressurized air sufficiently that it must be cooled, even if the ambient air temperature is very low. Thus, under most conditions, heat must be removed from air by the ECS before the air is delivered to the aircraft cabin. As heat is removed from the air, it is dissipated by the ECS into a separate stream of air that flows into the ECS, across heat exchangers in the ECS, and out of the aircraft, carrying the excess heat with it.

Clogging of the ECS heat exchanger is a common problem and as a result, customers often remove the heat exchanger at regular intervals for cleaning due to the performance degradation of the dirty clogged heat exchanger. The removal of the heat exchanger from the aircraft is time consuming and can potentially damage the heat exchanger or other equipment.

SUMMARY

A heat exchanger cleaning arrangement includes a spray tube array configured to be attached to a heat exchanger. The spray tube array includes at least one tube, a plurality of nozzles, and a connector. The plurality of nozzles is configured to port pressurized fluid from the at least one tube toward the heat exchanger. The connector is in operable communication with the spray bar array and is configured such that a pressurized fluid source can be attached to the connector for porting fluid from the pressurized fluid source to the plurality of nozzles.

A method of cleaning a heat exchanger includes connecting a pressurized fluid source to a spray bar array that is attached to a heat exchanger. Fluid is then flowed from the pressurized fluid source through at least one tube of the spray bar array and out of the at least one tube through a plurality of nozzles in the at least one tube toward a heat exchanger.

A heat exchanger system includes a heat exchanger, a spray tube, and a supply line. The Heat exchanger includes a housing, a series of fins disposed within the housing, a first ram inlet disposed in the heat exchanger housing, and a first ram outlet disposed in the heat exchanger housing opposite from the first ram inlet. The spray tube is disposed at the first ram outlet of the heat exchanger and is affixed to a portion of the housing and comprises a plurality of nozzles aligned towards the heat exchanger. The supply line is fluidly connected to the spray tube and includes a fluid conduit and a connector disposed on an end of the supply line.

The present summary is provided only by way of example, and not limitation. Other aspects of the present disclosure will be appreciated in view of the entirety of the present disclosure, including the entire text, claims, and accompanying figures.

Figure 1:
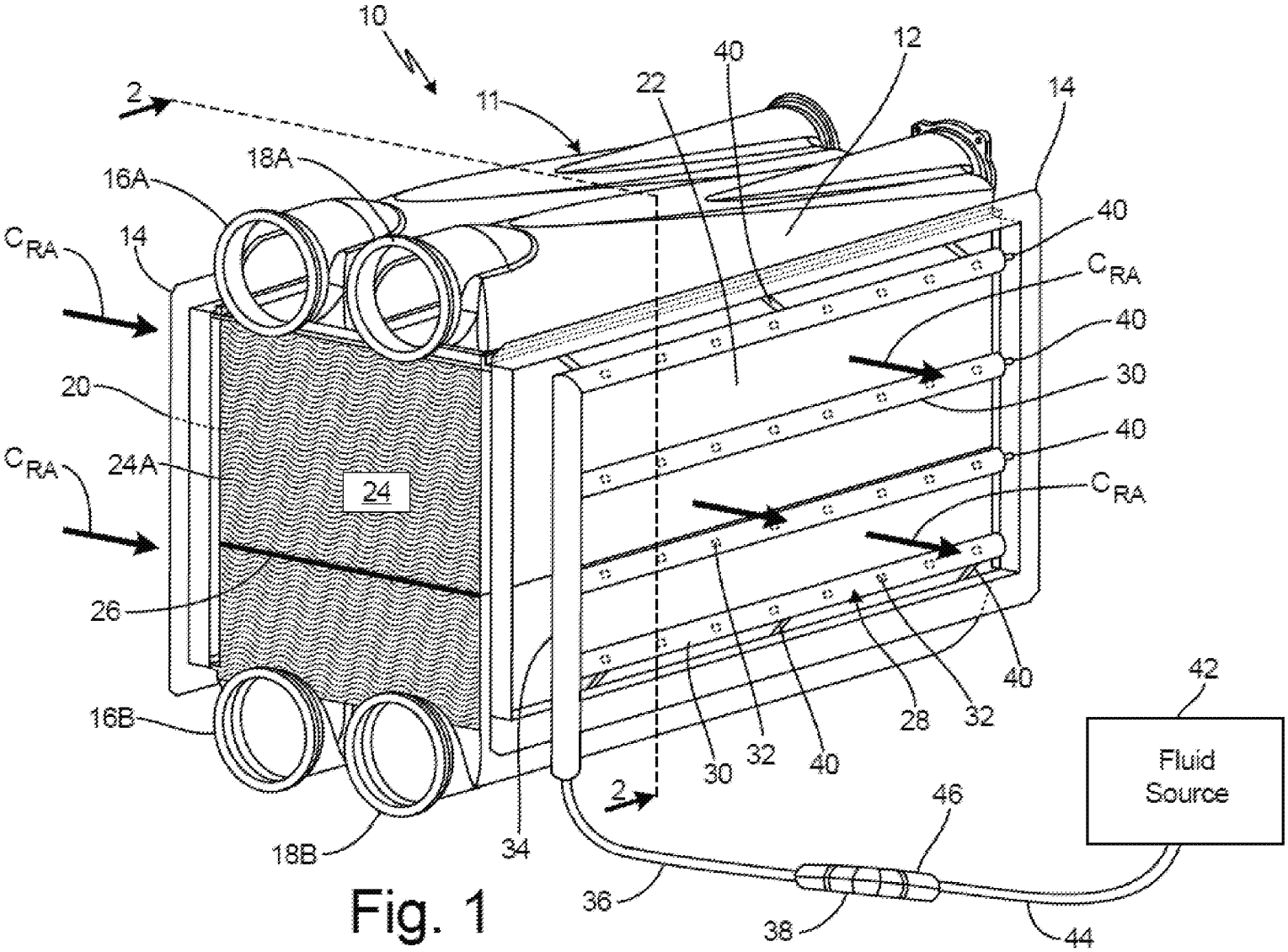
FIG. 1 is a schematicized perspective view of a heat exchanger of an environmental control system of an aircraft and shows a spray tube array mounted onto a flange of the heat exchanger.

While the above-identified figures set forth one or more embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

In the present disclosure, a spray tube array is mounted near the downstream face of the heat exchanger with an easily accessible connection to attach a high pressure water source in order to provide a consistent and repeatable cleaning process. The spray tube array covers as much of the heat exchanger outlet face as practical in order to back-flush the heat exchanger with water to remove any material clogging the heat exchanger. Existing access panels in some heat exchanger housings allow cleaning, but there is no easy way to guarantee total coverage with the water spray. The configuration presented herein allows for a repeatable cleaning process of the heat exchanger core without needing to remove the heat exchanger from the aircraft.

FIG. 1 is a schematicized perspective view of heat exchanger system 10 of an environmental control system ("ECS") of an aircraft and shows heat exchanger 11, housing 12, flanges 14, inlets 16A and 16B, outlets 18A and 18B, ram inlet 20, ram outlet 22, core 24 (with fins 24A), closure bar 26, ram air circuit $C_{RA}$, spray tube array 28 (with tubes 30, spray nozzles 32, and primary tube 34), supply line 36, connector 38, mounts 40, fluid source 42, source line 44, and connector 46.

Heat exchanger 11 is a heat exchanger with a plurality of fins (i.e., fins 24A) for transferring thermal energy between the fins and a fluid (e.g., one or more sources of air). Housing 12 is an external casing of heat exchanger 11. Flanges 14 are flanges for attaching heat exchanger 11 to other components of the ECS and/or aircraft. In this example, flanges 14 are picture frame flanges. Inlets 16A and 16B and outlets 18A and 18B are fluidic openings. Ram inlet 20 is a fluidic entry point for a source of ram air circuit $C_{RA}$ from the aircraft. Ram outlet 22 is a fluidic exit point from heat exchanger 11 of ram air circuit $C_{RA}$. Core 24 is a portion of heat exchanger 11 including heat exchanging fins 24 that are wavy sheets of solid material (e.g., metal) configured to transfer thermal energy between the heat exchanging fins and a fluid (e.g., ram air circuit $C_{RA}$) passing across the heat exchanging fins.

Closure bar 26 is a flat piece of solid material. Ram air circuit $C_{RA}$ is a fluidic pathway or flow path.

Spray tube array 28 is an assembly of tubes 30, spray nozzles 32, and primary tube 34. Tubes 30 and primary tube 34 are hollow tubes of solid material. In this example, tubes 30 include a circular cross-section shape (see e.g., FIG. 2). Spray nozzles 32 are orifices or openings. Supply line 36 and source line 44 are fluidic hoses or tubes for transporting a fluid. Connectors 38 and 46 are couplers or linking elements. In this example, connectors 38 and/or 40 can include threads for threadable engagement with each other. Mounts 40 are supports or struts. Fluid source 42 is a source of a pressurized fluid. In this example, fluid source 42 is a machine or device that provides a pressurized liquid for cleaning purposes, such as a portable pressure washer or similar apparatus.

Heat exchanger 11 is disposed in and as a component of the ECS (not shown) of an aircraft. Housing 12 is connected to other components of the aircraft ECS via flanges 14. Flanges 14 are mounted to housing 12 via permanent or mechanical engagement. Inlet 16A is located in a top portion (top/upward as shown in FIG. 1) of heat exchanger 11 and is fluidly connected to a first portion of core 24. Inlet 16B is located in a bottom portion (bottom/downward as shown in FIG. 1) of heat exchanger 11 and is fluidly connected to a second portion of core 24. Outlet 18A is disposed on an upper portion of heat exchanger 11 and is fluidly connected to the first portion of core 24. Outlet 18B is disposed on a lower portion of heat exchanger 11 and is fluidly connected to the second portion of core 24. Ram inlet 20 and ram outlet 22 disposed on opposite sides of housing 12 form each other and are both fluidly connected to core 24. Core 24 is disposed and contained in housing 12. Closure bar 26 is disposed through a portion of heat exchanger 11. Ram air circuit $C_{RA}$ passes heat exchanger 11 via ram inlet 20, through core 24, and out of heat exchanger 11 via ram outlet 22.

Spray tube array 28 is mounted to flanges 14 of housing 12 via mounts 40. Tubes 30 are connected to and extend from primary tube 34. Each of tubes 30 is fluidly connected to supply line 36 via primary tube 34. In this example, tubes 30 are oriented in a horizontal arrangement relative to the positioning of heat exchanger 11. In other examples, tubes 30 can include non-horizontal arrangements such as diagonal, vertical, as well as non-linear configurations such as circular or elliptical (see e.g., FIGS. 3A-3C). Spray nozzles 32 are disposed along tubes 30. In this example, spray nozzles are shown in phantom to depict their locations on a backside of tubes 30 as shown in FIG. 1 (e.g., on a side of tubes 30 facing towards core 24 of heat exchanger 11). Primary tube 34 is connected to tubes 30 and to supply line 36. Supply line 36 connects to primary tube 34 and to source line 44 via connectors 38 and 46. Connector 38 is attached on an end of supply line 36 and is connected to connector 46. Mounts 40 are attached to and extend from flanges 14. In other embodiments, mounts 40 can attach to portions of heat exchanger 11 other than at flanges 14 such as to housing 12 and/or directly to core 24.

Fluid source 42 is disposed externally from the ECS of the aircraft and is fluidly connected to spray tube array 28 via source line 44, connectors 46 and 38, and supply line 36. Source line 44 extends between and fluidly connects fluid source 42 and connector 46. Connector 46 is attached to source line 44 and is coupled to connector 38.

Heat exchanger 11 transfers thermal energy (via hot layers and cold layers in core 24) between ram air circuit $C_{RA}$ and other air circuits passing through heat exchanger housing 12 in order to provide conditioned air to the ECS of the aircraft. Housing 12 houses core 24 and contains the air flow of ram air circuit $C_{RA}$ and other air circuits within heat exchanger 11. Flanges 14 provide interfaces with which additional ECS components attach to. In this example, flanges 14 provide an attachment point for mounts 40 to mount to. Inlets 16A and 16B deliver flow of air circuits (e.g., bleed air circuit and/or fresh air circuit) into housing 12 and to core 24. Outlets 18A and 18B deliver flow of air circuits (e.g., bleed air circuit and/or fresh air circuit) from core 24 and out of housing 12. Ram inlet 20 receives ram air circuit $C_{RA}$ into housing 12 and to core 24. Ram outlet 22 delivers ram air circuit $C_{RA}$ from core 24 and out of housing 12. Core 24 effectuates transfer of thermal energy between ram air circuit $C_{RA}$ and the other air circuits passing therethrough. Closure bar 26 fluidly separates a first top portion of core 24 from a second bottom portion of core 24. Ram air circuit $C_{RA}$ provides a source of cold air flow into which thermal energy is transferred from the other air circuits passing through core 24 of heat exchanger 11.

For additional discussion of an exemplary heat exchanger, see commonly owned U.S. patent application Ser. No. 16/213,217 entitled "DUAL PASS HEAT EXCHANGER WITH DRAIN SYSTEM" filed on Dec. 7, 2018, which is herein incorporated by reference in its entirety.

Tubes 30 of spray tube array 28 deliver a spray of cleaning fluid onto and into ram outlet 20 to wash and/or flush the cleaning fluid through the fins of core 24 in order to clean any accumulated debris or particulate from core 24. In this non-limiting embodiment, the term cleaning fluid can be pressurized hot water with a (environmentally safe) detergent additive. For example, a heat exchanger cleaning process can involve multiple wash cycles (e.g., with the cleaning fluid) and rinse cycles (e.g., with plain water) until debris is no longer visible in heat exchanger 11 or in the waste liquid exiting heat exchanger 11.

In one example, tubes 30 of spray tube array 28 cover as much of ram outlet 22 as practical in order to back-flush core 24 with water to remove any material clogging heat exchanger 11. Spray nozzles 32 create or impart a spout or spray of fluid from each of tubes 30. Primary tube 34 delivers the cleaning fluid from supply line 36 to tubes 30. Supply line 36 delivers the cleaning fluid from source line 44 to primary tube 34. Connector 38 engages with connector 46 so as to fluidly connected source line 44 to supply line 36. Mounts 40 attach or affix spray tube array 28 to housing 12 of heat exchanger 11. Fluid source 42 provides a pressurized source of cleaning fluid to spray tube array 28. Source line 44 delivers the cleaning fluid from fluid source 42 to supply line 36.

With existing cleaning systems for heat exchangers, mechanics are required to access the heat exchanger by removing a panel in the aircraft exterior. Once the heat exchanger outlet is exposed, a temporary pressurized fluid apparatus (e.g., portable pressure washer) is used to introduce a pressurized stream of water onto the heat exchanger outlet. Use of a portable pressurized washer often results in a non-uniform spray of water and inconsistent spray coverage often leading to inefficient debris removal. There is no easy way to guarantee total coverage with the water spray with existing methods. In addition, there is a risk of the spray nozzle of the pressure washer coming into contact with the fins of the heat exchanger causing damage.

Heat exchanger 11 with spray tube array 28 eliminates the need to access heat exchanger 11 during each cleaning process because spray tube array 28 is integral with heat exchanger 11 and therefore does not need to be introduced during each cleaning instance. Spray tube array 28 also eliminates the need to completely remove heat exchanger 11 from the aircraft in order to clean heat exchanger 11, which can be a difficult and time consuming process necessary with existing cleaning processes. With the use of connector 38, an easily accessible connection point is available with which fluid source 42 can be quickly connected during maintenance checks in order to provide pressurized water to spray tube array 28.

Figure 2:
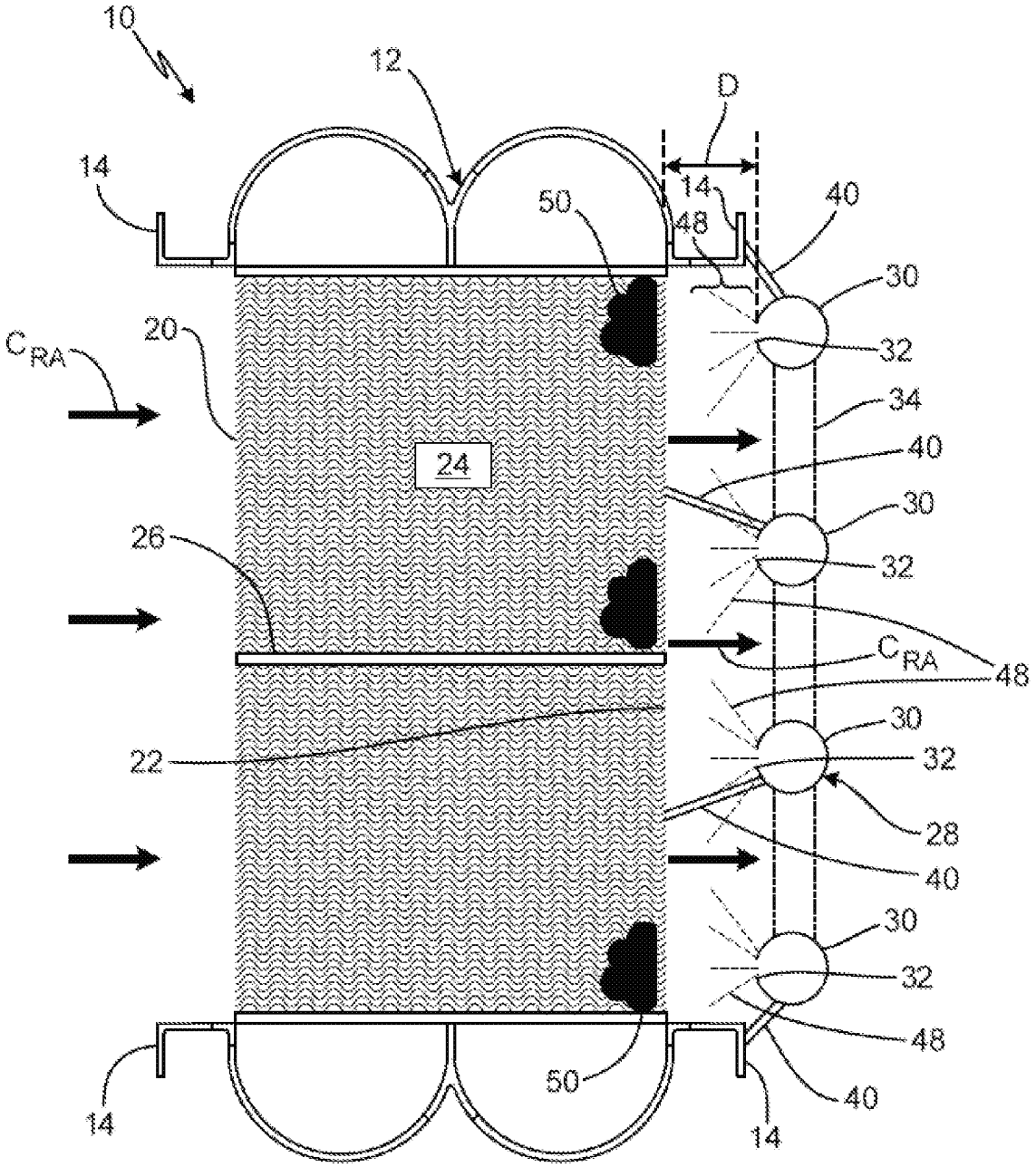
FIG. 2 is a section view taken along plane 2-2 in FIG. 1 of the heat exchanger and shows fluid spraying from the spray tube array.

FIG. 2 is a section view taken along plane 2-2 in FIG. 1 of heat exchanger 11. FIG. 2 shows fluid spraying from spray tube array 28 and includes heat exchanger 11, housing 12, flanges 14, ram inlet 20, ram outlet 22, core 24, closure bar 26, ram air circuit $C_{RA}$, spray tube array 28 (with tubes 30, spray nozzles 32, and primary tube 34), and mounts 40. FIG. 2 also shows distance D between core 24 and tubes 30, sprays 48, and debris 50.

Distance D is a length between core 24 and tubes 30. Sprays 48 are spray patterns of a cleaning fluid such as water. In this example, patterns of sprays 48 include a conical or fan shape. Debris 50 are lumps of accumulated particulate or dirt. Here, FIG. 2 shows additional mounts 40 attached to core 24 and to tubes 30. In this example, each of tubes 30 is set at a uniform distance D across the entire spray tube array 28. In other examples, one or more of tubes 30 can be set at a distance away from core 24 such that distance D is not uniform as between all of tubes 30 in spray tube array 28. Sprays 48 are sprayed out of or emitted from spray nozzles 32 of tubes 30. Debris 50 are disposed in portions (e.g., the fins) of core 24. In other examples other pieces of debris 50 can be located through any portion of core 24.

The additional mounts 40 attached to core 24 and to tubes 30 provide addition support to spray tube array 28 and further maintain a consistent distance D across all of spray tube array 28. With mounts 40 holding tubes 30 a set distance D from core 24, spray nozzles 32 are at a fixed distance from heat exchanger 11. Sprays 48 exit spray nozzles 32 and are sprayed through ram outlet 22 and into the fins of core 24 so as to flush out debris 50 from the fins with the cleaning fluid. As sprays 48 come into contact with the fins of core 24, debris 50 is removed from the fins of heat exchanger 11 with the cleaning fluid. Further, the cleaning fluid is then drained from the fins of core 24 by way of a drain in housing 12 or by flushing all the way out of core 24 through ram inlet 20.

Sizes of existing heat exchanger fins can be as small as 3/1000's inch thick. If a high velocity spray is introduced onto such small of fins at an incorrect angle or at a distance too close to the fins, the fins can become bent or damaged. Spray tube array 28 that is mounted directly to housing 12 via mounts 40 allows for better control of the heat exchanger cleaning process by holding spray nozzles 32 of tubes 30 at a fixed distance from the fins of core 24 thereby eliminating the risk of bending the fins of core 24 over with sprays 48 or by contacting the fins with tubes 30.

Figure 3A:
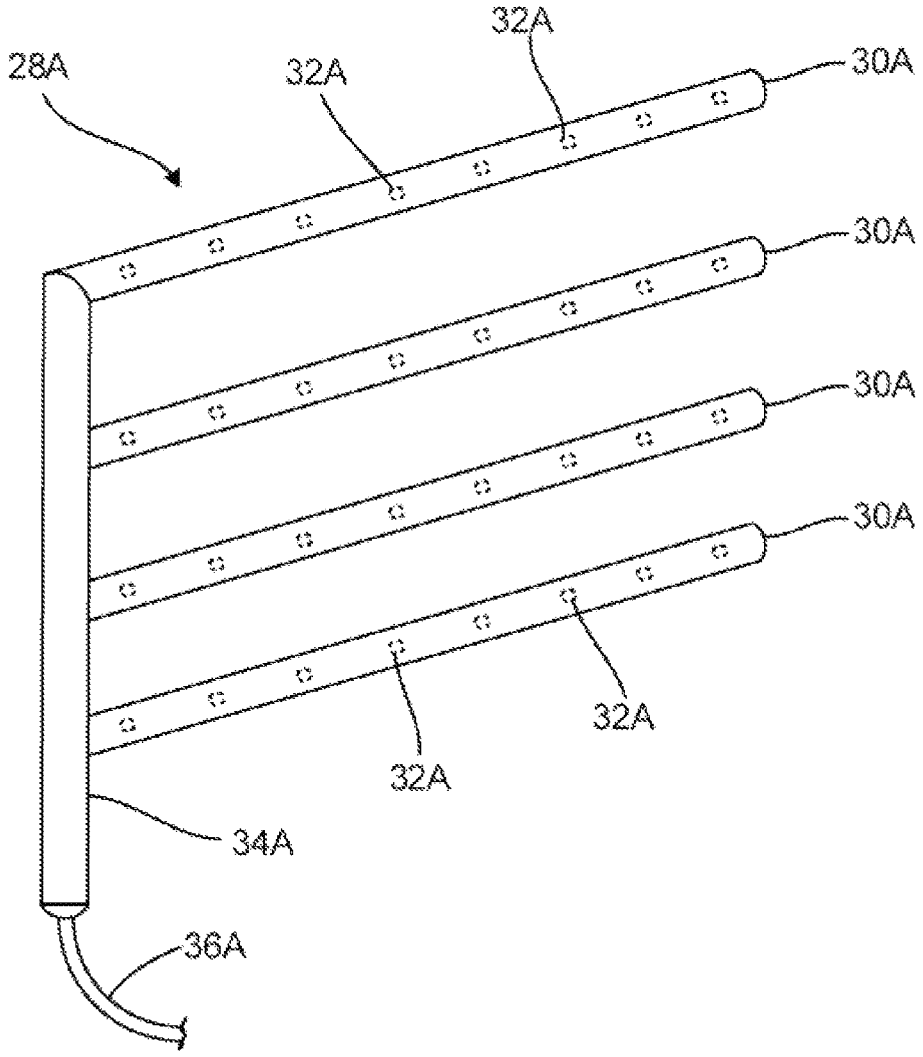
FIG. 3A is a front view of a first spray tube array with diagonal spray tubes.

FIG. 3A is a front view of spray tube array 28A and shows spray tubes 30A, spray nozzles 32A, primary tube 34A, and supply line 36A. Here, FIG. 3A shows tubes 30A of spray tube array 28A as including a diagonal direction. For example, tubes 30A are shown as including a downward slant in a right-to-left direction as shown in FIG. 3A. In this embodiment, tubes 30A are shown as extending along a straight line. In other embodiments, tubes 30A (or 30, 30B, and/or 30C) can include a horizontal, vertical, diagonal, circular, and/or wavy configuration.

The diagonal configuration of tubes 30A enables any residual cleaning fluid to drain from tubes 30A upon completion of spraying heat exchanger 11. This natural drainage of tubes 30A helps to prevent pooling and subsequent freezing of the cleaning fluid inside of tubes 30A which can cause damage to spray tube array 28A.

Figure 3B:
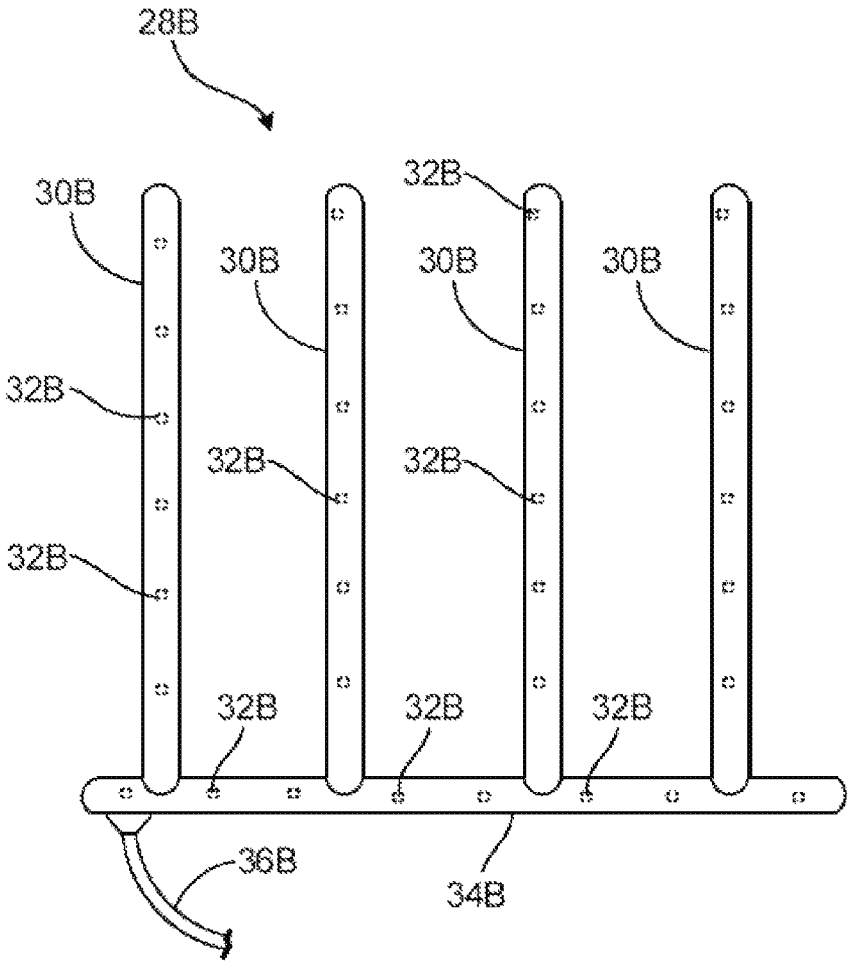
FIG. 3B is a front view of a second spray tube array with vertical spray tubes.

FIG. 3B is a front view of spray tube array 28B and shows spray tubes 30B, spray nozzles 32B, primary tube 34B, and supply line 36B. Here, FIG. 3B shows tubes 30B of spray tube array 28B as including a vertical orientation. tubes 30B are connected to primary tube 34B which also includes spray nozzles 32B in this embodiment.

This vertically orientated configuration of spray tube array 28B allows for the option of placing tubes 30B in a different pattern (than is shown in FIGS. 1-3A) which may be more suitable to clean heat exchanger 11 depending on the use and characteristics of the aircraft heat exchanger 11 is installed in. For example, with primary tube 34B including spray nozzles 32B, a larger amount of spray can be delivered to a gravitational bottom of core 24 where there could be a great amount of debris accumulation.

Figure 3C:
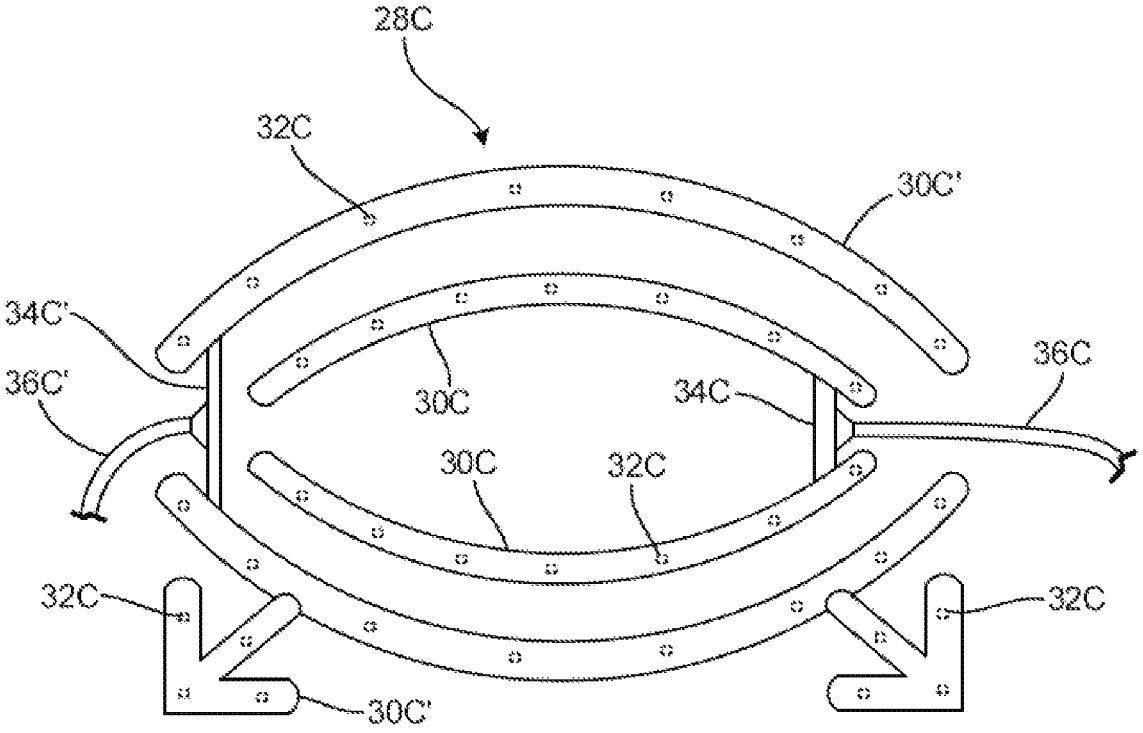
FIG. 3C is a front view of a third spray tube array with two separate spray tube circuits.

FIG. 3C is a front view of spray tube array 28C and shows first spray tubes 30C, second set of spray tubes 30C', spray nozzles 32C, first primary tube 34C, second primary tube 34C', first supply line 36C, and second supply line 36C'. First and second tubes 30C and 30C' are shown as included a curved, bowed, or lenticular (e.g., biconvex) shapes. Second tubes 30C' also include arrowhead shaped portions extending diagonally downward from the curved portions. These portions extending diagonally downwards assist with delivering the cleaning fluid to the bottom corners of core 24 where debris 50 can accumulate at a high rate due to quiescence caused by fluid flow dynamics within heat exchanger 11.

Here, spray tube array 28C is shown as including more than one set of tubes that are each connected to their own respective fluid circuit. Utilizing more than one fluid circuit in spray tube array 28C allows for differing spray patterns, different pressures, and different time periods of spraying the cleaning fluid from each of first tubes 30C and second tubes 30C'. Varying the flow patterns and timing from each of first tubes 30C and second tubes 30C' enables different portions of core 24 to be cleaned at different rates. This allows for an adaptive cleaning process as well as more targeted cleaning treatments to portions of heat exchanger 11 tending to collect more debris 50. For example, in the corner regions of ram outlet 22, quiescent zones are present where the airflow through core 24 is not quite as high as through the center of core 24 due to the turbulence and fluid flow dynamics within of heat exchanger 11. A configuration such as provided by spray tube array 28C allows for addition flow of the cleaning fluid at portions of core 24 that are more susceptible to clogging. The multiple fluid circuit configuration of spray tube array 28C allows delivery of varying amounts of pressure of cleaning fluid as needed based on a specific need of heat exchanger 11.

Figure 4A:
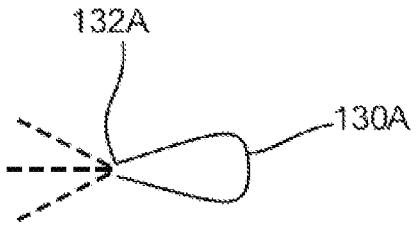
FIG. 4A is a cross-sectional view of first spray tube in a tear-drop shape.
Figure 4B:
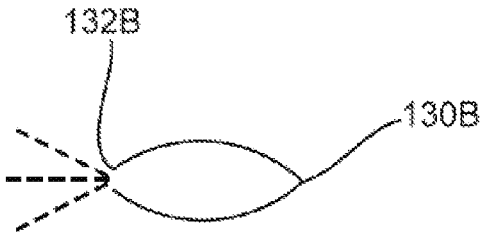
FIG. 4B is a cross-sectional view of second spray tube in a lenticular shape.
Figure 4C:
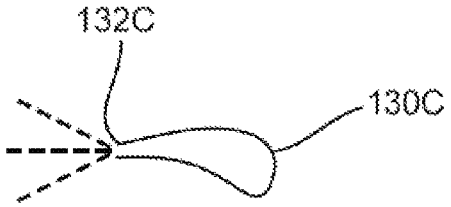
FIG. 4C is a cross-sectional view of third spray tube in an airfoil shape.

FIG. 4A is a cross-sectional view of first spray tube 130A in a tear-drop shape and shows spray nozzle 132A. FIG. 4B is a cross-sectional view of second spray tube 130B in a lenticular shape and shows spray nozzle 132B. FIG. 4C is a cross-sectional view of third spray tube 130C in an airfoil shape and shows spray nozzle 132C. Each of the cross-section shapes of tubes 130A, 130B, and 130C presented in FIGS. 4A, 4B, and 4C provide aerodynamic shapes in order to minimize a pressure drop of ram air circuit $C_{RA}$ flowing across the tubes. Any of the cross section shapes as shown by first, second, and third tubes 130A, 130B, and 130C can be incorporated, alone or in combination) into any of the configurations of tubes shown throughout FIGS. 1-4C.

Additionally, the airfoil shape of third tubes 130C allow third tubed 130C to direct or guide (e.g., turn) a portion or portions of ram air circuit $C_{RA}$ in certain directions as ram air circuit $C_{RA}$ exits out of ram outlet 22 of heat exchanger 11.

Discussion of Possible Embodiments

A heat exchanger cleaning arrangement includes a spray tube array configured to be attached to a heat exchanger. The spray tube array includes at least one tube, a plurality of nozzles, and a connector. The plurality of nozzles is configured to port pressurized fluid from the at least one tube toward the heat exchanger. The connector is in operable communication with the spray bar array and is configured such that a pressurized fluid source can be attached to the connector for porting fluid from the pressurized fluid source to the plurality of nozzles.

The arrangement of the preceding paragraph can optionally include, additionally and/or alternatively, any one or more of the following features, configurations and/or additional components.

Each tube of the array of spray tubes can be fluidly connected to a supply line.

The housing can include a flange at the outlet, wherein the spray tube array can be mounted to the heat exchanger at a flange of a housing of the heat exchanger.

A method of cleaning a heat exchanger includes connecting a pressurized fluid source to a spray bar array that is attached to a heat exchanger. Fluid is then flowed from the pressurized fluid source through at least one tube of the spray bar array and out of the at least one tube through a plurality of nozzles in the at least one tube toward a heat exchanger.

The method of the preceding paragraph can optionally include, additionally and/or alternatively, any one or more of the following steps, features, configurations and/or additional components.

A portion of the series of fins can be flushed with the fluid.

Debris can be removed from the series of fins of the heat exchanger with the fluid.

The fluid can be drained from the series of fins of the heat exchanger.

A heat exchanger system includes a heat exchanger, a spray tube, and a supply line. The Heat exchanger includes a housing, a series of fins disposed within the housing, a first ram inlet disposed in the heat exchanger housing, and a first ram outlet disposed in the heat exchanger housing opposite from the first ram inlet. The spray tube is disposed at the first ram outlet of the heat exchanger and is affixed to a portion of the housing and comprises a plurality of nozzles aligned towards the heat exchanger. The supply line is fluidly connected to the spray tube and includes a fluid conduit and a connector disposed on an end of the supply line.

The system of the preceding paragraph can optionally include, additionally and/or alternatively, any one or more of the following features, configurations and/or additional components.

Each spray tube of an array of spray tubes can be fluidly connected to the supply line.

The housing can include a flange at the outlet, wherein the spray tube can be mounted to the housing at the flange.

The heat exchanger can be a ram air heat exchanger that can be configured to connect to an environmental control system of an aircraft.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger cleaning arrangement comprising:

a spray tube array configured to be attached to a heat exchanger, the spray tube array comprising;

a first tube and a second tube, each of the first tube and the second tube being bowed;

a plurality of nozzles disposed in each of the first tube and the second tube and configured to port pressurized fluid from each of the first tube and the second tube toward the heat exchanger;

a first mount attached to a flange of a housing of the heat exchanger and connecting the first tube to the flange;

a second mount attached to a core of the heat exchanger and connecting the second tube to the core; and a connector in operable communication with the spray tube array and configured such that a pressurized fluid source can be attached to the connector for porting fluid from the pressurized fluid source to the plurality of nozzles;

wherein the first mount and the second mount space the first tube and second tube, respectively, apart from the core a uniform distance.

2. The heat exchanger cleaning arrangement of claim 1, further comprising a supply line, wherein each tube of the spray tube array is fluidly connected to the supply line.

3. The heat exchanger cleaning arrangement of claim 1, wherein the flange of the housing is positioned at a ram outlet side of the heat exchanger.

4. The heat exchanger cleaning arrangement of claim 1, wherein at least one of the first tube and the second tube extends along a curved shape.

5. The heat exchanger cleaning arrangement of claim 1, wherein the second tube includes an arrowhead shaped portion, the arrowhead portion disposed adjacent to a bottom corner of the core.

6. The heat exchanger cleaning arrangement of claim 1, and further comprising a primary tube fluidly connected to the supply line, wherein the primary tube is disposed adjacent to a side of the core and wherein the first and second tubes extend diagonally from the primary tube.

7. The heat exchanger cleaning arrangement of claim 1, and further comprising a primary tube fluidly connected to the supply line, wherein the primary tube is disposed at a bottom of the core and wherein the first and second tubes extend vertically from the primary tube.

8. The heat exchanger cleaning arrangement of claim 1, wherein at least one of the first tube and the second tube has one of a tear drop, airfoil, and lenticular cross-sectional shape.

9. The heat exchanger cleaning arrangement of claim 1, wherein the heat exchanger comprises a series of fins disposed within a core of the housing.

10. A method of cleaning a heat exchanger comprising:

connecting a pressurized fluid source to a spray tube array that is attached to the heat exchanger, the spray tube array comprising;

a first tube and a second tube, each of the first tube and the second tube being bowed;

a plurality of nozzles disposed in each of the first tube and the second tube and configured to port pressurized fluid from each of the first tube and the second tube toward the heat exchanger;

a first mount attached to a flange of a housing of the heat exchanger and connecting the first tube to the flange;

a second mount attached to a core of the heat exchanger and connecting the second tube to the core;

wherein the first mount and the second mount space the first tube and second tube, respectively, apart from the core a uniform distance; and flowing fluid from the pressurized fluid source through at least one of the first tube and second tube of the spray tube array and out of the at least one of the first tube and second tube through a plurality of nozzles in the at least one of the first tube and the second tube toward the heat exchanger.

11. The method of claim 10, further comprising:

flushing a portion of a series of fins of the heat exchanger with the fluid;

removing debris from the series of fins of the heat exchanger with the fluid; and draining the fluid from the series of fins of the heat exchanger.

12. A heat exchanger system comprising:

a heat exchanger comprising:

a housing;

a series of fins disposed within a core of the housing;

a first ram inlet disposed in the housing; and a first ram outlet disposed in the housing opposite from the first ram inlet;

a spray tube array disposed at the first ram outlet of the heat exchanger, wherein the spray tube array comprises:

a first tube and a second tube, each of the first tube and the second tube being bowed;

a plurality of nozzles disposed in each of the first tube and the second tube and configured to port pressurized fluid from each of the first tube and the second tube toward the heat exchanger;

a first mount attached to a flange of the housing of the heat exchanger and connecting the first tube to the flange;

a second mount attached to the core of the heat exchanger and connecting the second tube to the core;

wherein the first mount and the second mount space the first tube and second tube, respectively, apart from the core a uniform distance; and a supply line fluidly connected to the spray tube array, wherein the supply line comprises a fluid conduit and a connector disposed on an end of the supply line.

13. The heat exchanger system of claim 12, wherein the heat exchanger is a ram air heat exchanger that is configured to connect to an environmental control system of an aircraft.

14. The heat exchanger system of claim 12, wherein at least one of the first tube and the second tube is-extends along a curved shape.

15. The heat exchanger system of claim 12, wherein the second tube includes an arrowhead shaped portion, the arrowhead portion disposed adjacent to a bottom corner of the core.

16. The heat exchanger system of claim 12, and further comprising a primary tube fluidly connected to the supply line, wherein the primary tube is disposed adjacent to a side of the core and wherein the first and second tubes extend diagonally from the primary tube.

17. The heat exchanger system of claim 12, and further comprising a primary tube fluidly connected to the supply line, wherein the primary tube is disposed at a bottom of the core and wherein the first and second tubes extend vertically from the primary tube.

18. The heat exchanger system of claim 12, wherein at least one of the first tube and the second tube has one of a tear drop, airfoil, and lenticular cross-sectional shape.

* * * * *